US012150542B1

(12) United States Patent
Campbell

(10) Patent No.: US 12,150,542 B1
(45) Date of Patent: Nov. 26, 2024

(54) HAIR-STYLING DEVICE HAVING A PLURALITY OF ACCESSORIES

(71) Applicant: Rico S. Campbell, Fayetteville, NC (US)

(72) Inventor: Rico S. Campbell, Fayetteville, NC (US)

( * ) Notice: Subject to any disclaimer, the term of this patent is extended or adjusted under 35 U.S.C. 154(b) by 340 days.

(21) Appl. No.: 17/706,750

(22) Filed: Mar. 29, 2022

Related U.S. Application Data

(60) Provisional application No. 63/286,601, filed on Dec. 7, 2021.

(51) Int. Cl.
*A45D 37/00* (2006.01)
*A46B 15/00* (2006.01)

(52) U.S. Cl.
CPC ..... *A46B 15/0061* (2013.01); *A46B 15/0059* (2013.01)

(58) Field of Classification Search
CPC ..... A45D 24/04; A45D 24/10; A45D 24/16; A45D 24/18; A45D 24/22; A45D 24/24; A45D 2200/1009; A46B 15/0059; A46B 15/0061; A46B 2200/104; A46B 2200/1046
See application file for complete search history.

(56) References Cited

U.S. PATENT DOCUMENTS

| | | | | |
|---|---|---|---|---|
| 1,831,667 | A * | 11/1931 | Johnson | A46B 5/0033 132/121 |
| 2007/0125397 | A1* | 6/2007 | Harewood | A46B 15/0077 132/121 |
| 2011/0083292 | A1* | 4/2011 | Boyd | A46B 15/0002 15/160 |
| 2016/0316903 | A1* | 11/2016 | Carroll | A46B 15/0055 |
| 2022/0031039 | A1* | 2/2022 | Fellows | A46B 15/0059 |

* cited by examiner

*Primary Examiner* — Rachel R Steitz
(74) *Attorney, Agent, or Firm* — Kyle A. Fletcher, Esq.

(57) ABSTRACT

The fluid hairstyler is an item of hairdressing equipment. The fluid hairstyler grooms the hair of a patient. The fluid hairstyler aligns the hair of a patient. The fluid hairstyler applies a cosmetic media to the hair of the patient. The fluid hairstyler comprises a brush structure, a plurality of storage slots, a comb, and a pick. The plurality of storage slots are formed in the brush structure. The comb inserts into a first storage slot selected from the plurality of storage slots for storage. The pick inserts into a second storage slot selected from the plurality of storage slots for storage. The brush structure applies the cosmetic media to the hair. The brush structure, the comb, and the pick align the hair of the patient.

10 Claims, 9 Drawing Sheets

HAIR-STYLING DEVICE HAVING A PLURALITY OF ACCESSORIES

CROSS REFERENCES TO RELATED APPLICATIONS

This non-provisional application claims priority under 35 USC 119(e) to U.S. provisional application 63/286,601 filed on Dec. 7, 2021, by the inventor: Rico S Campbell. This non-provisional application claims U.S. provisional application 63/286,601 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of brushes and brushware. (A46B1/00)

SUMMARY OF INVENTION

The fluid hairstyler is an item of hairdressing equipment. The fluid hairstyler grooms the hair of a patient. The fluid hairstyler aligns the hair of a patient. The fluid hairstyler applies a cosmetic media to the hair of the patient. The fluid hairstyler comprises a brush structure, a plurality of storage slots, a comb, and a pick. The plurality of storage slots are formed in the brush structure. The comb inserts into a first storage slot selected from the plurality of storage slots for storage. The pick inserts into a second storage slot selected from the plurality of storage slots for storage. The brush structure applies the cosmetic media to the hair. The brush structure, the comb, and the pick align the hair of the patient.

These together with additional objects, features and advantages of the fluid hairstyler will be readily apparent to those of ordinary skill in the art upon reading the following detailed description of the presently preferred, but nonetheless illustrative, embodiments when taken in conjunction with the accompanying drawings.

In this respect, before explaining the current embodiments of the fluid hairstyler in detail, it is to be understood that the fluid hairstyler is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fluid hairstyler.

It is therefore important that the claims be regarded as including such equivalent construction insofar as they do not depart from the spirit and scope of the fluid hairstyler. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
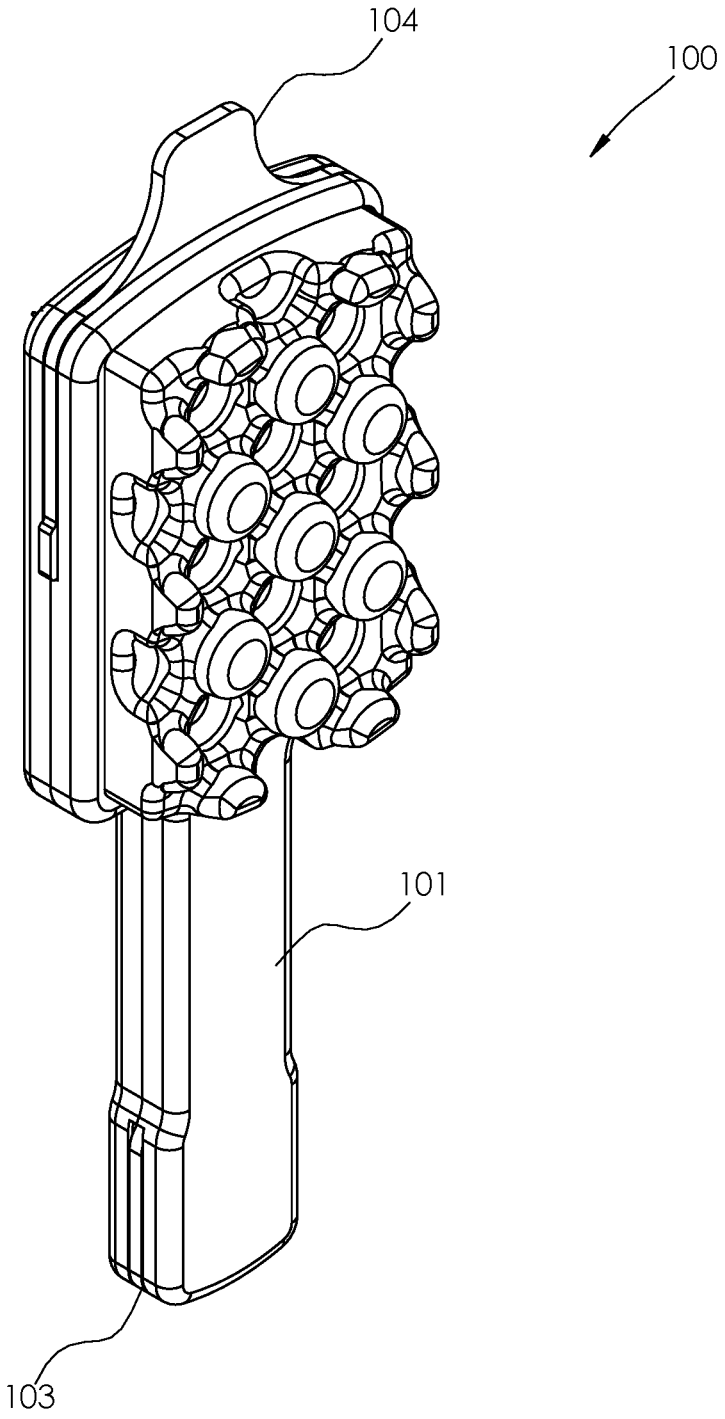
FIG. 1 is perspective view of an embodiment of the disclosure.
Figure 2:
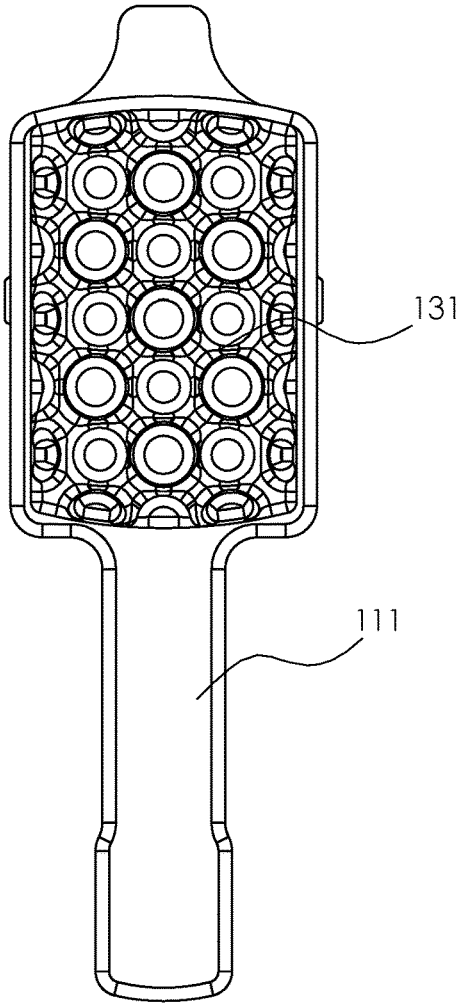
FIG. 2 is a top view of an embodiment of the disclosure.
Figure 3:
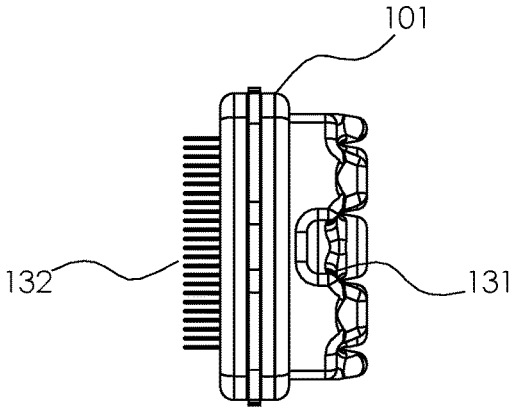
FIG. 3 is a front view of an embodiment of the disclosure.
Figure 4:
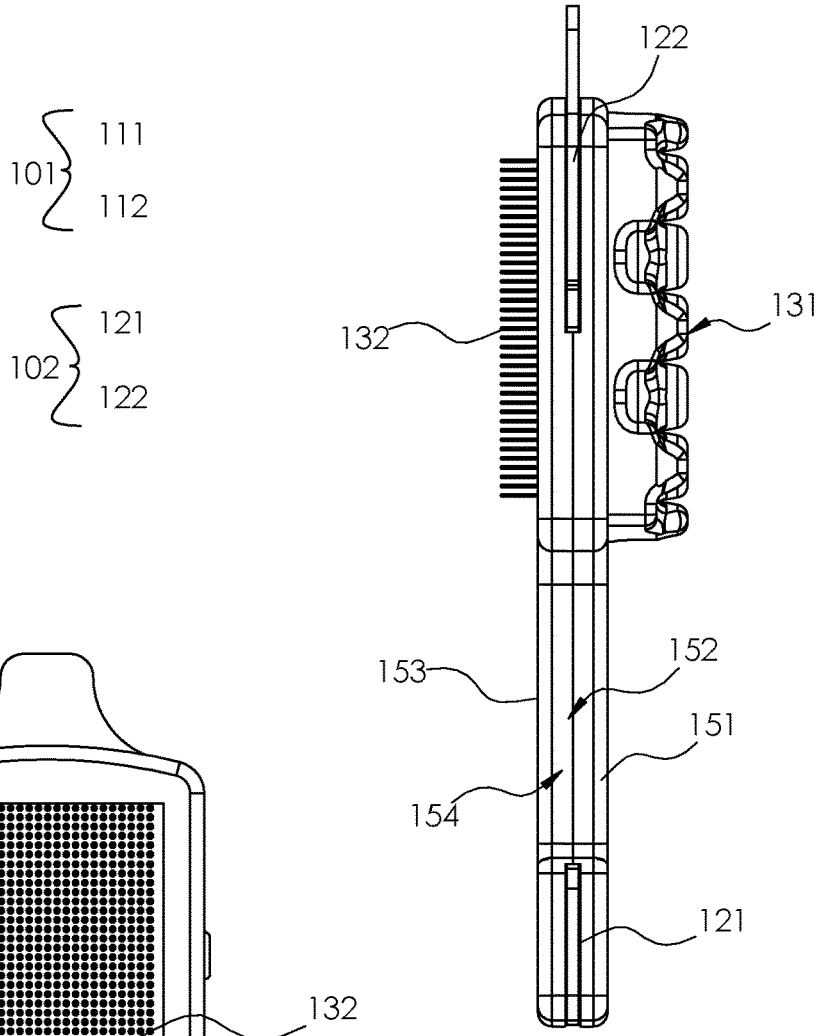
FIG. 4 is a side view of an embodiment of the disclosure.
Figure 5:
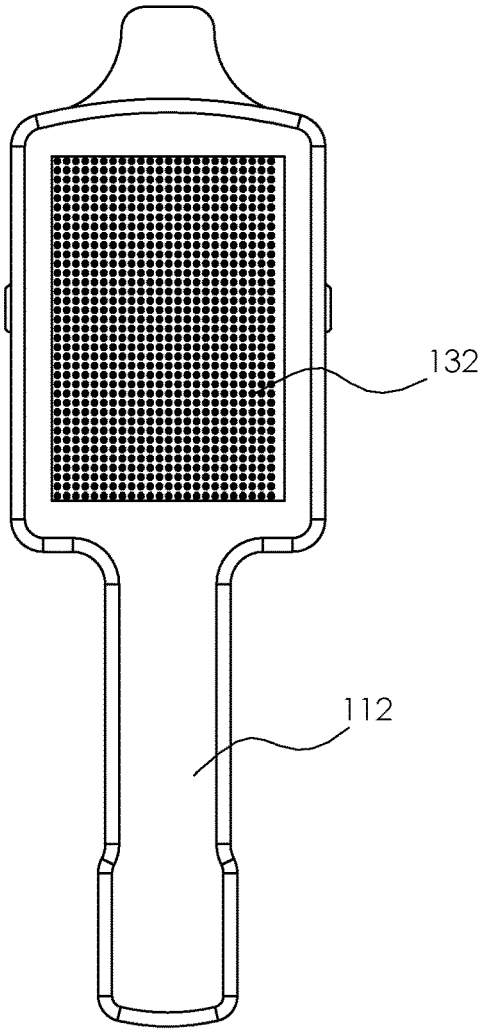
FIG. 5 is a rear view of an embodiment of the disclosure.
Figure 6:
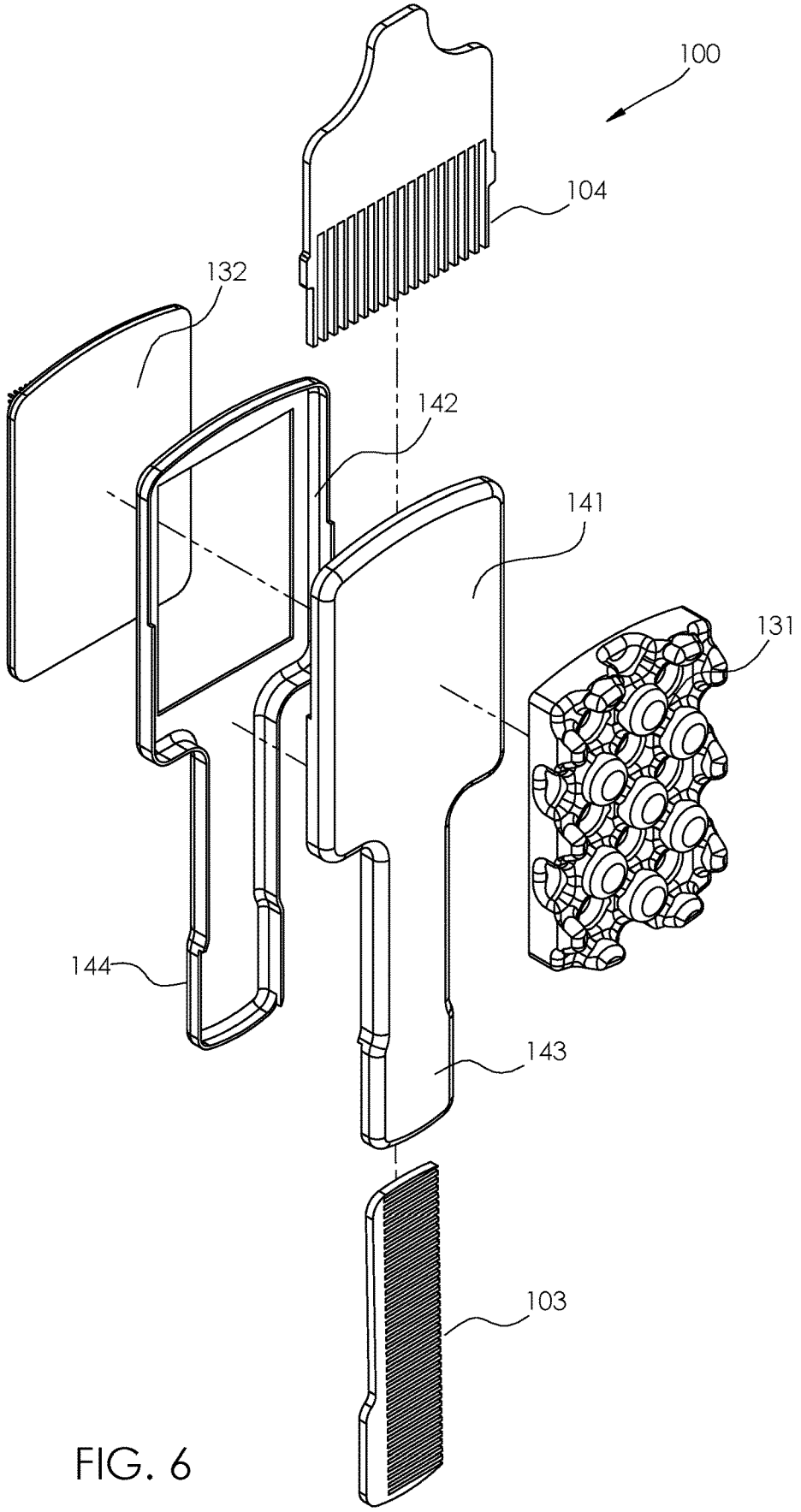
FIG. 6 is an exploded view of an embodiment of the disclosure.
Figure 7:
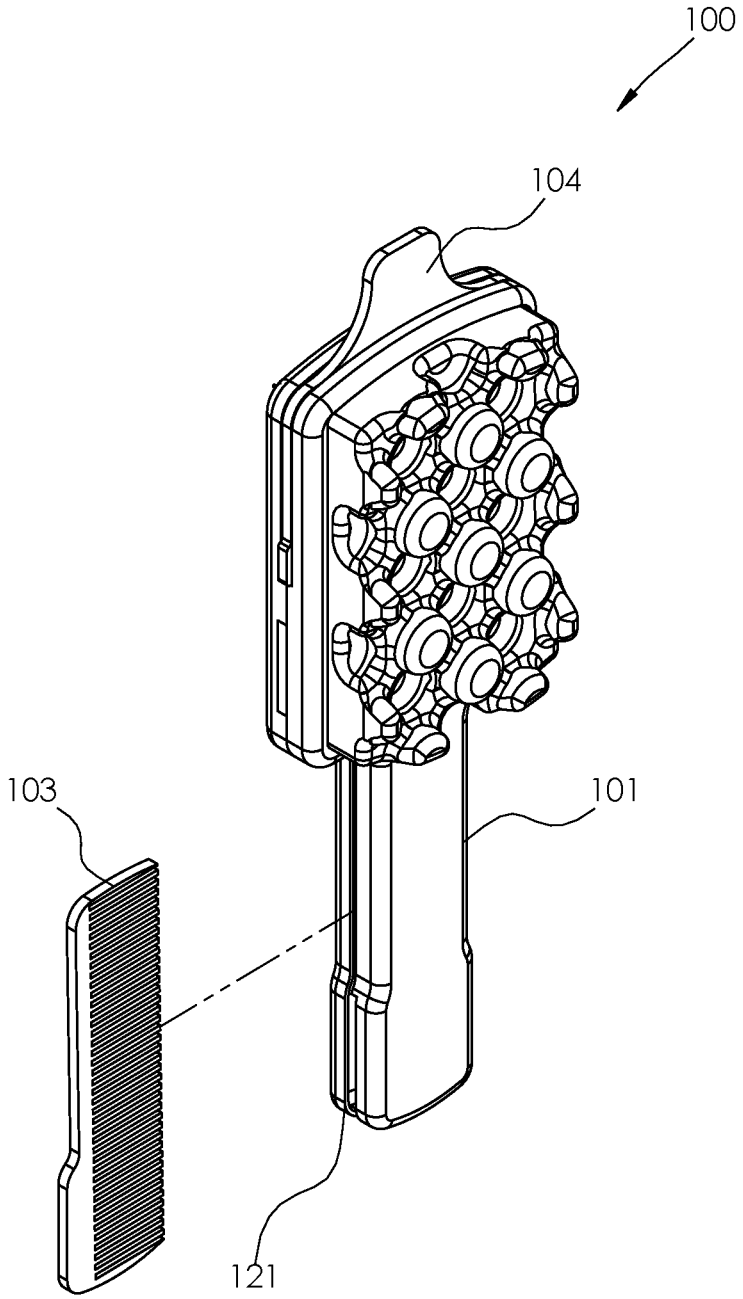
FIG. 7 is perspective view of an alternate embodiment of the disclosure.
Figure 8:
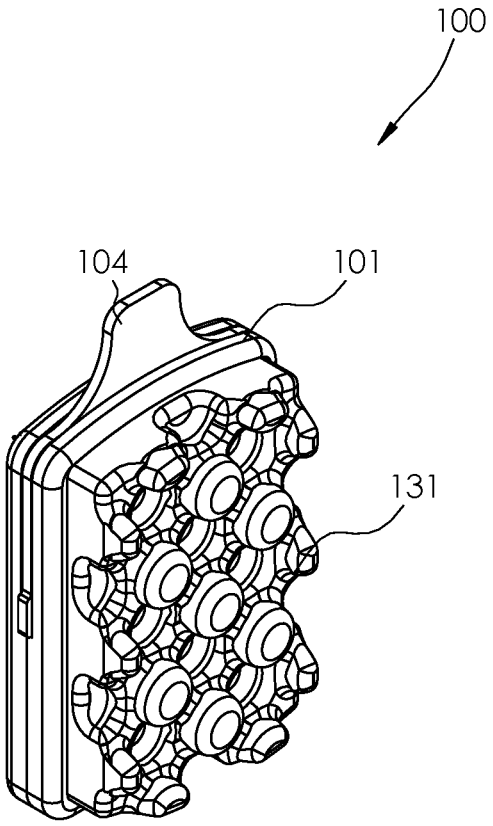
FIG. 8 is perspective view of an alternate embodiment of the disclosure.
Figure 9:
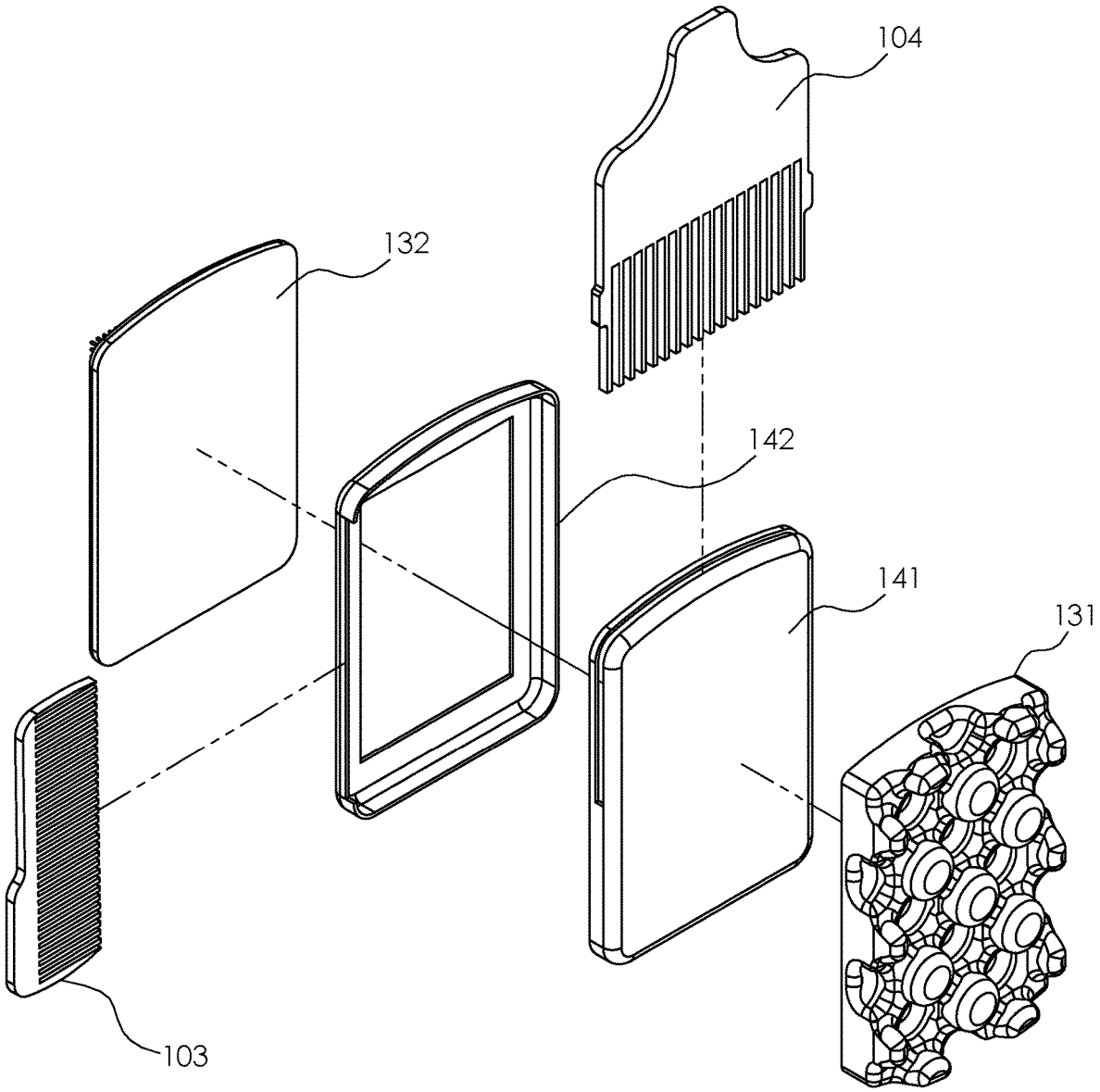
FIG. 9 is an exploded view of an alternate embodiment of the disclosure.
Figure 10:
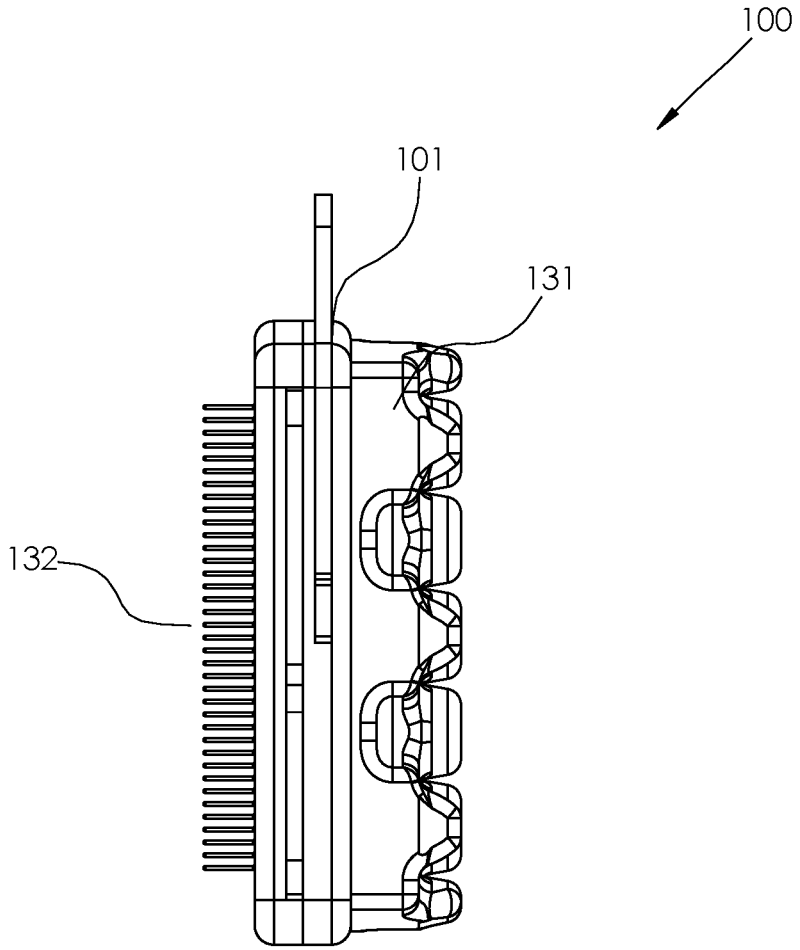
FIG. 10 is a side view of an alternate embodiment of the disclosure.
Figure 11:
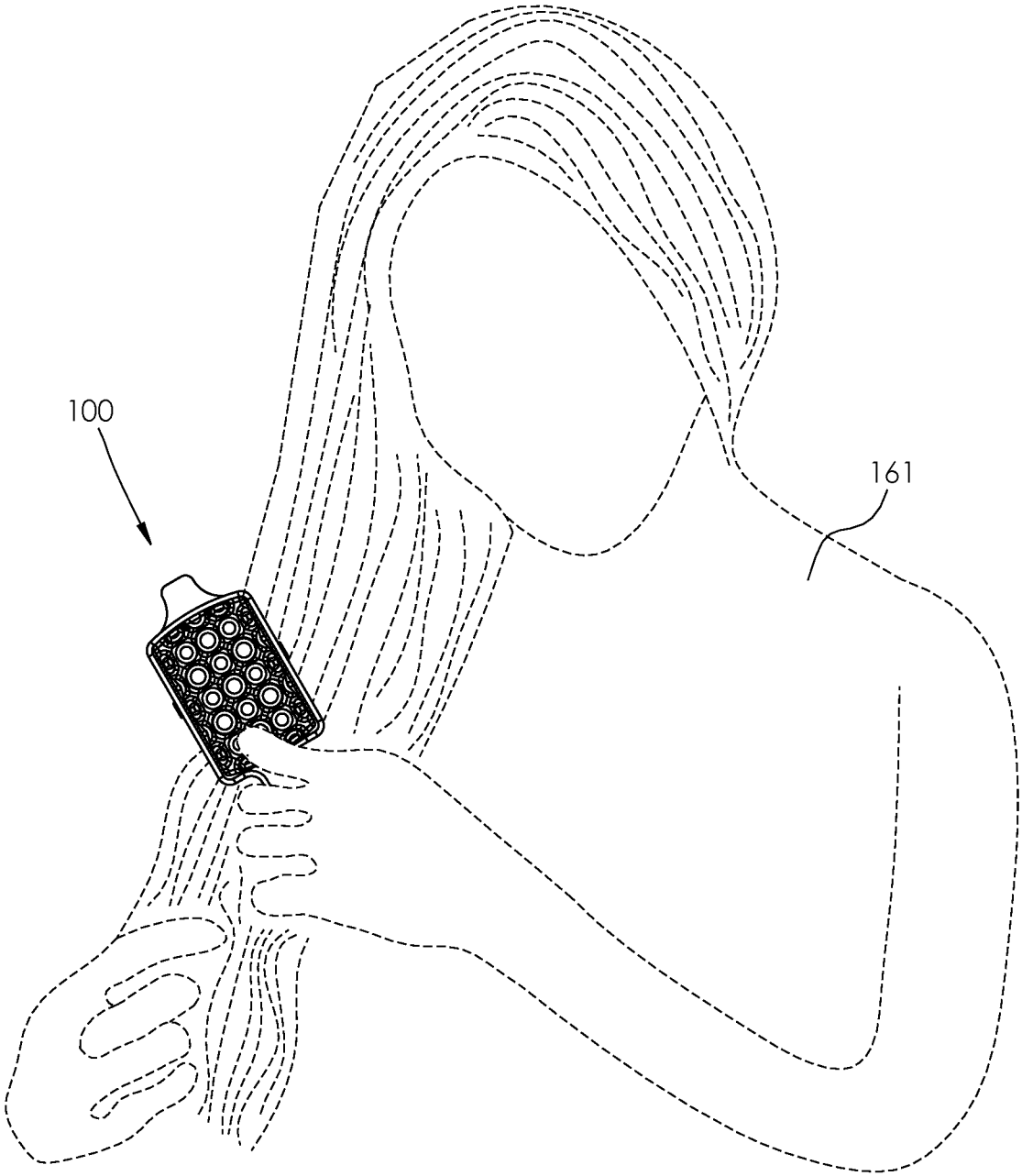
FIG. 11 is an in-use view of an embodiment of the disclosure.

Detailed reference will now be made to one or more potential embodiments of the disclosure, which are illustrated in FIGS. 1 through 11.

The fluid hairstyler 100 (hereinafter invention) is an item of hairdressing equipment. The invention 100 grooms the hair of a patient 161. The invention 100 aligns the hair of a patient 161. The invention 100 applies a cosmetic media to the hair of the patient 161. The invention 100 comprises a brush structure 101, a plurality of storage slots 102, a comb 103, and a pick 104. The plurality of storage slots 102 are formed in the brush structure 101. The comb 103 inserts into a first storage slot selected from the plurality of storage slots 102 for storage. The pick 104 inserts into a second storage slot selected from the plurality of storage slots 102 for storage. The brush structure 101 applies the cosmetic media to the hair. The brush structure 101, the comb 103, and the pick 104 align the hair of the patient 161.

The comb 103 is a mechanical structure. The comb 103 is a tool formed by the invention 100 used to align the hair of the patient 161. The comb 103 is defined elsewhere in this disclosure. The pick 104 is a mechanical structure. The pick 104 is a tool formed by the invention 100 used to align the hair of the patient 161. The pick 104 is defined elsewhere in this disclosure.

The brush structure 101 is a mechanical structure. The brush structure 101 is a tool formed by the invention 100 used to align the hair of the patient 161. The brush structure 101 is the tool formed by the invention 100 used to apply the cosmetic media to the hair of the patient 161. The brush structure 101 forms the physical structure used to store the comb 103 and the pick 104. Each storage slot selected from the plurality of storage slots 102 is a negative space formed in the brush structure 101. The brush structure 101 comprises sponge 131 plate 111 and a brush plate 112.

The sponge 131 plate 111 is a disk shaped structure. The sponge 131 plate 111 forms a portion of the exterior surface of the brush structure 101. The sponge 131 plate 111 attaches to the brush plate 112 to form the brush structure 101. The sponge 131 plate 111 comprises a sponge 131, a first exterior face 151, a first interior face 152 and a first disk 141.

The first disk 141 is a disk shaped structure. The first disk 141 forms base structure of the sponge 131 plate 111.

The sponge 131 is an absorbent structure. The sponge 131 is defined elsewhere in this disclosure. The sponge 131 receives and absorbs the cosmetic media into the capillary structure of the sponge 131. The sponge 131 physically applies the cosmetic media to the hair of the patient 161. The sponge 131 mounts on the first exterior face 151 of the first disk 141 of the sponge 131 plate 111.

The first exterior face 151 is the congruent end of the first disk 141 structure of the sponge 131 plate 111 that is distal from the brush plate 112 when the brush plate 112 attaches to the sponge 131 plate 111. The first exterior face 151 forms a portion of the external surfaces of the brush structure 101. The first interior face 152 is the congruent end of the first disk 141 structure of the sponge 131 plate 111 that is proximal to the brush plate 112 when the brush plate 112 attaches to the sponge 131 plate 111. The first interior face 152 forms a portion of the external surfaces of the brush structure 101.

The brush plate 112 is a disk shaped structure. The brush plate 112 forms a portion of the exterior surface of the brush structure 101. The brush plate 112 attaches to the sponge 131 plate 111 to form the brush structure 101. The brush plate 112 is geometrically similar to the sponge 131 plate 111.

The brush plate 112 attaches to the sponge 131 plate 111 such that the perimeter of the congruent ends of the disk structure of the brush plate 112 align with the perimeter of the congruent ends of the disk structure of the sponge 131 plate 111. The brush plate 112 attaches to the sponge 131 plate 111 such that the brush plate 112 is offset from the sponge 131 plate 111. By offset is meant that a negative space is formed between the brush plate 112 and the sponge 131 plate 111 when the brush plate 112 attaches to the sponge 131 plate 111. The brush plate 112 is a tool formed by the invention 100. The tool formed by the brush plate 112 is used to align the hair of the patient 161. The sponge 131 plate 111 is a tool formed by the invention 100. The tool formed by the sponge 131 plate 111 is used to apply the cosmetic media to the hair of the patient 161.

The brush plate 112 comprises a plurality of bristles 132, a second exterior face 153, a second interior face 154 and a second disk 142. The second disk 142 is a disk shaped structure. The second disk 142 forms base structure of the brush plate 112. The perimeter of the second disk 142 aligns with the perimeter of the first disk 141 when the brush plate 112 attaches to the sponge 131 plate 111. The attachment of the brush plate 112 to the sponge 131 plate 111 forms a negative space between second disk 142 and the first disk 141.

The second exterior face 153 is the congruent end of the second disk 142 structure of the brush plate 112 that is distal from the sponge 131 plate 111 when the brush plate 112 attaches to the sponge 131 plate 111. The second exterior face 153 forms a portion of the external surfaces of the brush structure 101. The second interior face 154 is the congruent end of the second disk 142 structure of the brush plate 112 that is proximal to the sponge 131 plate 111 when the brush plate 112 attaches to the sponge 131 plate 111. The second interior face 154 forms a portion of the external surfaces of the brush structure 101.

Each bristle selected from the plurality of bristles 132 is a stiff prism shaped structure. The plurality of bristles 132 physically aligns the hair of the patient 161 by passing the hair of the patient 161 between adjacent bristles selected from the plurality of bristles 132. The plurality of bristles 132 mount on the second exterior face 153 of the second disk 142 of the brush plate 112.

Each storage slot selected from the plurality of storage slots 102 is geometrically similar to a structure selected from the group consisting of: a) the comb 103; and, b) the pick 104. Each storage slot selected from the plurality of storage slots 102 is sized such that that selected storage slot contains a structure selected from the group consisting of: a) the comb 103; and, b) the pick 104. The plurality of storage slots 102 further comprises a comb 103 storage slot 121 and a pick 104 storage slot 122.

The comb 103 storage slot 121 is a negative space formed in the brush structure 101. The comb 103 storage slot 121 is the negative space formed between the first interior face 152 of the sponge 131 plate 111 and the second interior face 154 of the brush plate 112. The comb 103 storage slot 121 is geometrically similar to the comb 103. The comb 103 storage slot 121 is sized such that the comb 103 inserts into the comb 103 storage slot 121 for storage.

The pick 104 storage slot 122 is a negative space formed in the brush structure 101. The pick 104 storage slot 122 is the negative space formed between the first interior face 152 of the first disk 141 of the sponge 131 plate 111 and the second interior face 154 of the second disk 142 of the brush plate 112. The pick 104 storage slot 122 is geometrically similar to the pick 104. The pick 104 storage slot 122 is sized such that the pick 104 inserts into the pick 104 storage slot 122 for storage.

In a second potential embodiment of the disclosure, the sponge plate 111 further comprises a third disk 143. The brush plate 112 further comprises a fourth disk 144.

The third disk 143 is a disk shaped structure. The third disk 143 attaches to the first disk 141 to form the sponge 131 plate 111 into a lateral disk structure. The lateral face of the disk structure of the third disk 143 attaches to the lateral face of the first disk 141 to form the lateral disk structure.

The fourth disk 144 is a disk shaped structure. The fourth disk 144 attaches to the second disk 142 to form the brush 121 plate 112 into a lateral disk structure. The lateral face of the disk structure of the fourth disk 144 attaches to the lateral face of the second disk 142 to form the lateral disk structure of the brush plate 112. The fourth disk 144 is geometrically identical to the third disk 143. The perimeter of the fourth disk 144 aligns with the perimeter of the third disk 143 when the brush plate 112 attaches to the sponge 131 plate 111. The attachment of the brush plate 112 to the sponge 131 plate 111 forms a negative space between fourth disk 144 and the third disk 143.

The third disk 143 and the fourth disk 144 combine to form a handle.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bristle: As used in this disclosure, a bristle is a short coarse stiff hair or hair like object.

Brush: As used in this disclosure, a brush is a tool comprising a plurality of bristles set into a handle or a base that is used for grooming, sweeping, smoothing, scrubbing, or painting.

Cant: As used in this disclosure, a cant is an angular deviation from one or more reference lines (or planes) such as a vertical line (or plane) or a horizontal line (or plane).

Capillary Action: As used in this disclosure, capillary action refers to the tendency of a liquid to experience adhesion forces when exposed to surface or surfaces formed within a narrow structure and the tendency of a liquid to flow as a result of these adhesion force. In the proper circumstances, the adhesive forces of capillary action can overcome gravitational forces or the intermolecular forces that form liquids. The span of the lengths where capillary action predominates is often referred to as a microfluidic scale. On a practical level, the concept of wicking and wicking fabrics rely primarily on capillary action.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Comb: As used in this disclosure, a comb is a toothed device that is used for detangling or otherwise arranging flexible linear objects. The term pick refers to a type of comb.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cosmetic Media: As used in this disclosure, a cosmetic media refers to a chemical substance that is topically applied to a biological organism. The purposes for a cosmetic media include, but are not limited to: a) cleaning the skin and the hair of the biological organism; b) changing the visual, olfactory, and tactile stimuli presented by the biological organism to other nearby biological organisms; and, c) the topical application of a pharmacologically active media.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Exterior: As used in this disclosure, the exterior is used as a relational term that implies that an object is not contained within the boundary of a structure or a space.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Interior: As used in this disclosure, the interior is used as a relational term that implies that an object is contained within the boundary of a structure or a space.

Lateral Disk Structure: As used in this disclosure, a lateral disk structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Negative Space: As used in this disclosure, negative space is a method of defining an object through the use of open or empty space as the definition of the object itself, or, through the use of open or empty space to describe the boundaries of an object.

Offset: As used in this disclosure, an offset refers to the span of distance or cant by which two objects are out of alignment.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Pharmacologically Active Media: As used in this disclosure, a pharmacologically active media refers to a chemical substance that has a biochemical or physiological effect on a biological organism.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Patient: As used in this disclosure, a patient is a person who is designated to receive a medical treatment, therapy, or service. The term patient may be extended to an animal when used within the context of the animal receiving veterinary treatment or services.

Sponge: As used in this disclosure, a sponge is a material, generally with a fibrous structure, that is capable of absorbing and retaining liquids through capillary action.

Teeth: As used in this disclosure, the teeth refer to a plurality of working elements of a tool that interact with an object in order to cut or align the object. An individual working element selected form the plurality of working elements is called a tooth.

Tool: As used in this disclosure, a tool is a device, an apparatus, or an instrument that is used to carry out an activity, operation, or procedure. A tool generally comprises a working element and a handle.

Topical: As used in this disclosure, topical is an adjective that is associated with a pharmacologically active media. Topical indicates that the pharmacologically active media is applied directly to the skin.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 11 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A fluid hairstyler comprising a brush structure, a plurality of storage slots, a comb, and a pick;

wherein the plurality of storage slots are formed in the brush structure;

wherein the plurality of storage slots further comprises a comb storage slot and a pick storage slot;

wherein the comb inserts into the comb storage slot;

wherein the pick inserts into the pick storage slot;

wherein the brush structure comprises a sponge plate and a brush plate;

wherein the sponge plate attaches to the brush plate to form the brush structure;

wherein the sponge plate comprises a sponge, a first exterior face, a first interior face and a first disk;

wherein the brush plate comprises a plurality of bristles, a second exterior face, a second interior face and a second disk;

wherein the attachment of the brush plate to the sponge plate forms a negative space between the second disk and the first disk;

wherein the negative space between the second disk and the first disk is the comb storage slot;

wherein the comb storage slot is formed between the first interior face of the sponge plate and the second interior face of the brush plate.

2. The fluid hairstyle according to claim 1 wherein the fluid hairstyler is an item of hairdressing equipment;

wherein the fluid hairstyler grooms the hair of a patient;

wherein the fluid hairstyler aligns the hair of a patient;

wherein the fluid hairstyler applies a cosmetic media to the hair of the patient.

3. The fluid hairstyle according to claim 2 wherein the brush structure is a mechanical structure;

wherein the brush structure is a tool used to align the hair of the patient;

wherein the brush structure is the tool used to apply the cosmetic media to the hair of the patient;

wherein the brush structure forms the physical structure used to store the comb and the pick.

4. The fluid hairstyle according to claim 3, wherein each storage slot selected from the plurality of storage slots is geometrically similar to a structure selected from the group consisting of: a) the comb; and, b) the pick;

wherein each storage slot selected from the plurality of storage slots is sized such that that selected storage slot contains a structure selected from the group consisting of: a) the comb; and, b) the pick.

5. The fluid hairstyle according to claim 4 wherein the sponge plate is a disk shaped structure;

wherein the sponge plate forms a portion of the exterior surface of the brush structure;

wherein the brush plate is a disk shaped structure;

wherein the brush plate forms a portion of the exterior surface of the brush structure;

wherein the brush plate is geometrically similar to the sponge plate;

wherein the brush plate attaches to the sponge plate such that the perimeter of the congruent ends of the disk structure of the brush plate align with the perimeter of the congruent ends of the disk structure of the sponge plate;

wherein the brush plate attaches to the sponge plate such that the brush plate is offset from the sponge plate.

6. The fluid hairstyle according to claim 5 wherein the first disk is a disk shaped structure;

wherein the first disk forms base structure of the sponge plate;

wherein the sponge is an absorbent structure;

wherein the sponge mounts on the first exterior face of the first disk of the sponge plate;

wherein the first exterior face is the congruent end of the first disk structure of the sponge plate that is distal from the brush plate when the brush plate attaches to the sponge plate;

wherein the first exterior face forms a portion of the external surfaces of the brush structure;

wherein the first interior face is the congruent end of the first disk structure of the sponge plate that is proximal to the brush plate when the brush plate attaches to the sponge plate;

wherein the first interior face forms a portion of the external surfaces of the brush structure.

7. The fluid hairstyle according to claim 6 wherein the second disk is a disk shaped structure;

wherein the second disk forms base structure of the brush plate;

wherein the perimeter of the second disk aligns with the perimeter of the first disk when the brush plate attaches to the sponge plate;

wherein the second exterior face is the congruent end of the second disk structure of the brush plate that is distal from the sponge plate when the brush plate attaches to the sponge plate;

wherein the second exterior face forms a portion of the external surfaces of the brush structure;

wherein the second interior face is the congruent end of the second disk structure of the brush plate that is proximal to the sponge plate when the brush plate attaches to the sponge plate;

wherein the second interior face forms a portion of the external surfaces of the brush structure;

wherein each bristle selected from the plurality of bristles is a stiff prism shaped structure;

wherein the plurality of bristles physically aligns the hair of the patient by passing the hair of the patient between adjacent bristles selected from the plurality of bristles;

wherein the plurality of bristles mount on the second exterior face of the second disk of the brush plate.

8. The fluid hairstyle according to claim 7 wherein the comb storage slot is geometrically similar to the comb;

wherein the comb storage slot is sized such that the comb inserts into the comb storage slot for storage.

9. The fluid hairstyle according to claim 8 wherein the pick storage slot is formed between the first interior face of the first disk of the sponge plate and the second interior face of the second disk of the brush plate;

wherein the pick storage slot is geometrically similar to the pick;

wherein the pick storage slot is sized such that the pick inserts into the pick storage slot for storage.

10. The fluid hairstyle according to claim 9 wherein the sponge plate further comprises a third disk;

wherein the brush plate further comprises a fourth disk;

wherein the third disk is a disk shaped structure;

wherein the third disk attaches to the first disk to form the sponge plate into a lateral disk structure;

wherein the lateral face of the disk structure of the third disk attaches to the lateral face of the first disk to form the lateral disk structure;

wherein the fourth disk is a disk shaped structure;

wherein the fourth disk attaches to the second disk to form the brush plate into a lateral disk structure;

wherein the lateral face of the disk structure of the fourth disk attaches to the lateral face of the second disk to form the lateral disk structure of the brush plate;

wherein the fourth disk is geometrically identical to the third disk;

wherein the perimeter of the fourth disk aligns with the perimeter of the third disk when the brush plate attaches to the sponge plate;

wherein the attachment of the brush plate to the sponge plate forms a negative space between fourth disk and the third disk;

wherein the third disk and the fourth disk combine to form a handle.

* * * * *